US006802641B2

(12) United States Patent
Ladatto et al.

(10) Patent No.: US 6,802,641 B2
(45) Date of Patent: Oct. 12, 2004

(54) INVERTIBLE MIXING SYSTEM WITH ANGLED BLADE ASSEMBLY AND METHOD FOR MIXING POWDERS WITH SUCH SYSTEM

(75) Inventors: Steven M. Ladatto, Lake Kiowa, TX (US); Don Hughes, Nocona, TX (US); Gareth Seatherton, Gainesville, TX (US)

(73) Assignee: Spraylat Corporation, Inc., Pelham, NY (US)

( * ) Notice: Subject to any disclaimer, the term of this patent is extended or adjusted under 35 U.S.C. 154(b) by 83 days.

(21) Appl. No.: 10/324,729

(22) Filed: Dec. 19, 2002

(65) Prior Publication Data

US 2004/0120214 A1 Jun. 24, 2004

(51) Int. Cl.[7] ..... B01F 9/08
(52) U.S. Cl. ..... 366/200
(58) Field of Search ..... 366/197, 200, 366/201, 330.1, 330.3, 270, 202, 224, 238

(56) References Cited

U.S. PATENT DOCUMENTS 2,240,841 A * 5/1941 Flynn ..... 366/330.1
3,307,834 A 3/1967 Wilde
3,610,540 A * 10/1971 Krolopp et al. ..... 366/330.1

(List continued on next page.)

FOREIGN PATENT DOCUMENTS

DE 31 23 362 A1 12/1982
WO 82/04407 * 12/1982

OTHER PUBLICATIONS

European Search Report, dated Feb. 23, 2004, issued for European patent application counterpart of above application.

David Bate et al., The Science of Powder Coatings Applications, vol. 2, pp. 259–261, Published by SINTA Technology, London, England (1994).

*Primary Examiner*—Charles E. Cooley
(74) *Attorney, Agent, or Firm*—Gerald K. White

(57) ABSTRACT

A mixing system employing a rotary blade mixing assembly designed to mix liquid-like, resinous powders with a particulate tinting agent or other additive to produce a uniform, homogeneous powder is disclosed. The mixing system includes a mixing container that may be inverted up to 180° and includes a rotary blade mixing assembly having at least two sets of mixing blades connected to a central shaft and arranged in parallel planes, each set having at least two mixing blades which are connected to the central shaft. Each blade is pitched at an angle to about 20° to about 45° from horizontal as measured following a 180° inversion of the mixing container. Use of the method of the invention is advantageous when uniform color of the final coating powder is desired. The method comprises utilizing the above-mentioned mixing container to hold at least two powders, placing a mixing head containing the above-mentioned rotary blade mixing assembly in the container in sealed relationship, inverting the mixing container while commencing rotation of the mixing blades, and mixing the powders with a blade tip speed of from about 1,000 ft/min to about 5,000 ft/min to cause the powders to be lifted along the container side walls and fall down a central portion of the container. The mixing container is then returned to its original position.

11 Claims, 2 Drawing Sheets

U.S. PATENT DOCUMENTS 3,892,388 A * 7/1975 Wass et al. ..... 366/325.7
4,135,828 A * 1/1979 Cabak ..... 366/197
4,506,989 A * 3/1985 Reh ..... 366/270
4,601,583 A * 7/1986 Amorese ..... 366/343
4,671,666 A * 6/1987 Herfeld ..... 366/197
4,676,658 A * 6/1987 Herfeld ..... 366/197
4,781,468 A * 11/1988 Herfeld ..... 366/213
4,896,971 A * 1/1990 Weetman et al. ..... 366/330.2
4,930,897 A * 6/1990 Herfeld et al. ..... 366/98
4,957,373 A * 9/1990 Derksen et al. ..... 366/197
5,123,747 A 6/1992 Derksen
5,762,417 A * 6/1998 Essen et al. ..... 366/264
6,250,797 B1 * 6/2001 Weetman ..... 366/270
6,331,070 B1 * 12/2001 Desai ..... 366/197

* cited by examiner

INVERTIBLE MIXING SYSTEM WITH ANGLED BLADE ASSEMBLY AND METHOD FOR MIXING POWDERS WITH SUCH SYSTEM

The present invention is directed to a mixing system and method of mixing for use in blending powders. The invention is especially suitable for blending coating powders, particularly where one component is a liquid-like, resinous base composition and another is a tinting agent or other additive in finely ground, dry powder form. Such blending results in a coating powder of uniform, homogenous properties, with color being an especially important property.

BACKGROUND OF THE INVENTION

Various systems and methods for mixing powders are well known in the industry.

U.S. patent application Ser. No. 10/102,216 of Steven M. Ladatto, filed Mar. 20, 2002, entitled "Coating Powder Compositions and Methods" is directed to providing a liquid-like, resinous coating powder base composition having a melt viscosity of from about 2 Pa·s to about 85 Pa·s. Such base compositions typically range in particle size from about 20 to about 200 microns. These base compositions can be produced in large batches, and then smaller portions of such batches can be mixed with various tinting agents and/or other additives to obtain a small batch of a desired coating powder having a desired color or other property. Typically, tinting agents are in a finely ground state having a particle size of 5 microns or less, or preferably, 3 microns or less to maximize total surface area per unit mass. Other additives may include particle sizes on the order of 10 microns or less and may range upwardly to about 35 microns or more.

The above-mentioned patent application discloses mixing of the respective powders into a final coating powder using a conventional mixing vessel that imparts shear to the materials, thereby producing the desired uniform, homogeneous coating powder. A suitable high intensity mixer mentioned in the patent application is commercially available from Henschel. Henschel mixers have a mixing blade disposed near the bottom of the mixing container. Mixing start-up occurs while the material to be mixed surrounds the mixing blade, thereby incurring the need for more powder during startup than if the mixer were to be started under no-load conditions. Such blades typically may comprise four mixing blades located at the bottom of the mixing container. The blades have nominal pitch (less than about 5° from horizontal). The four blades are in sets of two balanced, oppositely disposed blades. Each set of two blades is located above the other set. Thus, each set of two blades is in separate planes. Henschel mixers of the type described above are designed to mix and reduce the size of raw materials rather than to mix powders.

Other potentially useful mixers are available commercially from Mixaco and are further described in *The Science of Powder Coating Applications*, Volume 2, pages 259–261, published by SITA Technology, London, England, 1994. Such mixers are described to operate by loading premix materials into a cone-bottomed container, clamping a mixing lid containing a mixing blade to the top of the container, inverting the container/mixing lid assembly through 180°, commencing mixing, stopping mixing, and moving the container/mixing lid back through 180°, and then discharging the mixed product. These mixers typically utilize a two-blade set mixing assembly having the blades disposed generally perpendicular (90°) to the mixing container bottom.

The mixing system and method of the invention possess several significant advantages when contrasted to the above-described mixing systems and methods. First of all, while a Henschel high intensity mixer could be used to produce a suitable product, when used to mix the liquid-like, low melt viscosity resinous base powders mentioned above, there may be a tendency to heat and fuse such powders on the mixer blade. Fused powder on the blades can subsequently flake off and contaminate, or introduce non-uniformity in, the finished, mixed powder. The present invention does not encounter the above-mentioned fusion problem because its blade design promotes rapid, efficient mixing and the resultant short mixing times minimize the amount of heat buildup due to friction.

Secondly, Henschel mixers are not inverted during use; thereby its mixing blades are not started under no-load conditions. On the other hand, the method of the present invention involves no-load starting and thus capitalizes on the inversion of the mixing container. This advantage is especially beneficial in the mixing of powders because the blade is in motion as the powders gradually make contact with the blade. As the container reaches 90° on its way to being inverted 180°, the contents of the container begin to fall onto the blade. This method has at least two advantages. First, a gradual load on the motor which permits the use of a smaller motor when contrasted to using a design which has the entire weight of the material at rest on the blade when the blade rotation is started. Secondly, variable mixing dynamics occur between 90° and 180° rotation. This mixing dynamic permits the powder to move in various directions on the way to its 180° inversion position which then incurs a predictable mixing dynamic.

As stated above, the above-described Mixaco mixers appear not to be designed to mix powders in the manner of the present invention. This conclusion is apparent when differences between blade design and rotation speed are considered.

Neither the Henschel nor the Mixaco mixers discussed above employ the rotary blade mixing assembly and blade design of the present invention. Such blade design is adapted for use in mixing liquid-like resinous powders, especially when one powder component is a resinous powder having a viscosity from about 2 Pa·s to about 85 Pa·s and a particle size ranging from about 20 to about 200 microns.

SUMMARY OF THE INVENTION

Figure 2:
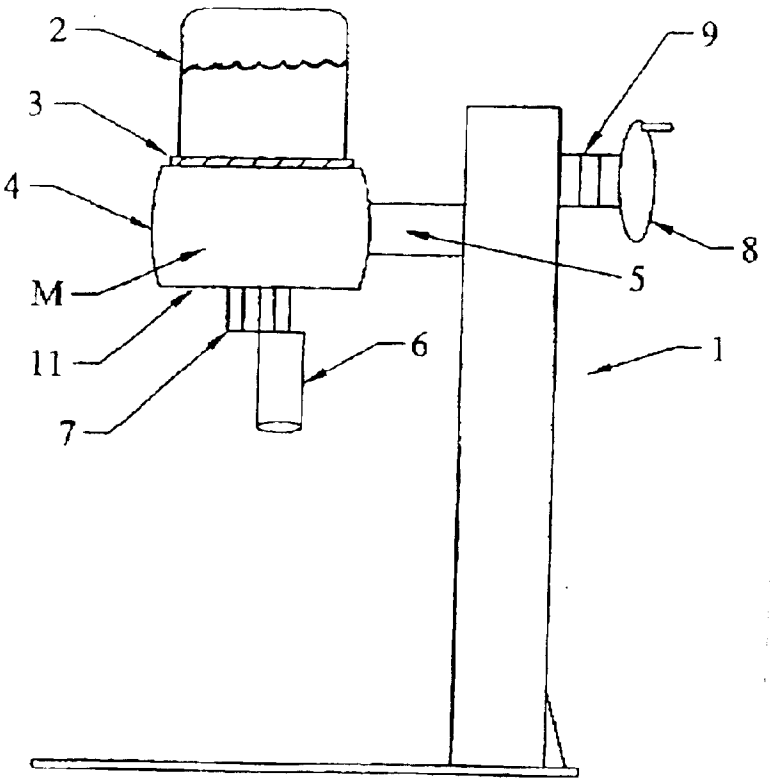
FIG. 2 is a front view of the mixing system of the invention including an assembly and mixing container held in such assembly wherein the container is in its inverted position.

The present invention comprises a system for mixing materials which includes an assembly for holding and inverting a mixing container, the assembly having means for inverting the mixing container up to about 180° and having a mixing head containing a rotary blade mixing assembly which is connected to a shaft. The rotary blade mixing assembly has at least two sets of mixing blades connected to a central shaft and arranged in parallel planes. Each set has at least two mixing blades which are connected to the central shaft. Each blade is pitched at an angle from about 20° to about 45° from horizontal as measured following a 180° inversion of the mixing container. The mixing container holds materials to be mixed and has a closed bottom portion, an open upper portion, and sidewalls and is held in a generally upright position by the assembly. The upper portion of the mixing container is placed in sealed relationship with the mixing head in a manner that the rotary blade mixing assembly extends into an upper portion of the mixing container. Power means connected to the mixing bead shaft cause rotation of said shaft, thereby causing rotation of the mixing blades.

The present invention also includes a method of mixing powders which comprises the steps of:

(a) Providing a mixing container having a closed bottom portion, an open top portion, and sidewalls which contains at least two powders in an amount that does not extend to the top of said container, thereby creating a space at the top of said powders;

(b) Holding the mixing container in an upright position in an assembly and placing a mixing head contained in the assembly in sealed relationship with the open top portion of the mixing container, the mixing head having a rotary blade mixing assembly comprising at least two sets of mixing blades connected to a central shaft and arranged in parallel planes, each set having at least two mixing blades which are connected to said central shaft, and each blade pitched at an angle from about 20° to about 45° from horizontal as measured following a 180° inversion of the mixing container, the rotary blade mixing assembly extending into the space in the mixing container;

(c) Commencing rotation of the mixing blades in the above-mentioned space;

(d) Inverting the mixing container while the mixing blades are rotating to cause the powders to fall to the former top portion of the mixing container;

(e) Rotating the mixing blades at a blade tip speed from about 1000 ft/min to about 5000 ft/min to cause the powders to be lifted along the container side walls and then to fall down along a central portion of the mixing container, thereby obtaining a uniform, homogeneous powder mixture;

(f) Counter inverting the mixing container to its original position; and (g) Removing the mixing container from said assembly.

DETAILED DESCRIPTION OF THE INVENTION

The present invention pertains to a mixing system and method for mixing powders, specifically for mixing dry tints or other additives, etc., with a resinous powder to form uniform, homogeneous mixtures. The system utilizes several advantageous concepts designed to benefit the methodology of producing tinted powder coatings that are set forth below.

The mixing system, which uses modular mixing containers, imparts highly intense shear and mixing to the powder components. An advantageous feature is a rotary blade mixing assembly which revolves at blade tip speeds between about 1000 ft/min to about 5000 ft/min. A mixing blade assembly has at least two sets of blades, at least two blades each, that are disposed parallel to each other which function to obtain excellent mixing properties. The system is designed for ease of cleanup between batches with use of modular mixing containers. The system has a variable speed drive and an inverting mixing head which houses the motor, gearbox, mounting flange, and rotary blade mixing assembly. The mixing container is attached to the mixing head in an essentially sealed relationship so as to minimize powder leakage. When the mixing head is inverted following startup of the rotary blade mixing assembly, the powder contents of the container come into contact with the rotary blade system. After the mixing cycle is complete, the mixing container, which is still attached to the mixing head, is rotated to counter-inverted position so the mixing container can be emptied while still held by the assembly or after removal, through a suitable discharge member, such as a valve. Once the container is detached, vacuuming or the like is used to clean the mixing head and a new container attached for prompt, further production.

Figure 1:
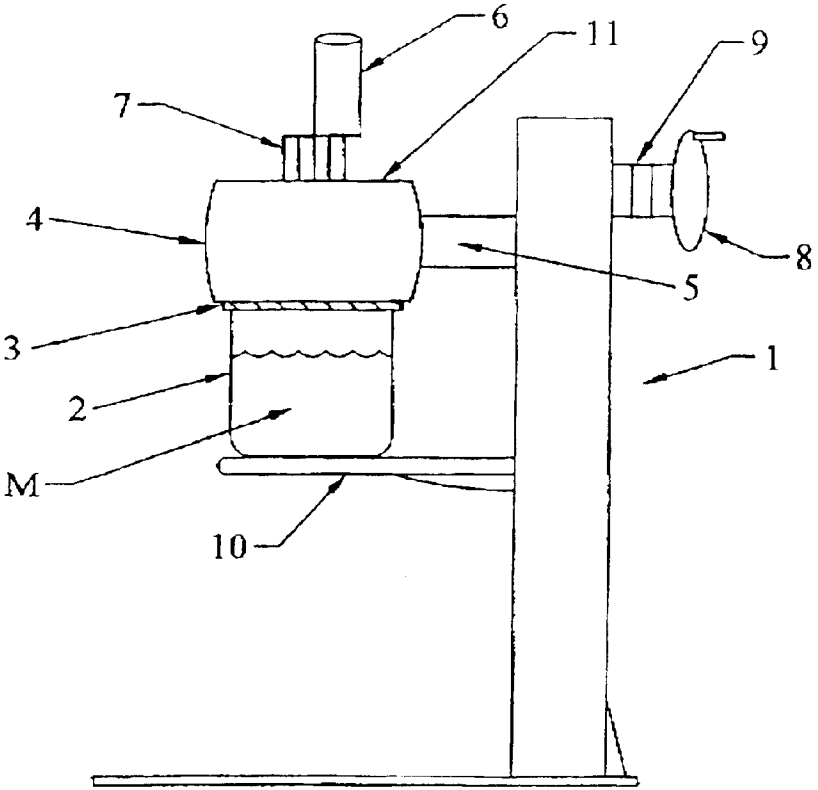
FIG. 1 is a front view of mixing system of the invention including an assembly and mixing container held in such assembly wherein the container is in its initial position.

FIG. 1 is a front view of mixing system M of the invention prior to inversion. Assembly 1 conveniently holds mixing container 2 in an upright position through holding means (not shown in drawing). Such holding arrangement may simply constitute lift bolts connected to the assembly through placement in slots or other openings connected to the container. Many other holding arrangements would occur and also be suitable. Mixing container 2, having a closed bottom, open top portions, and sidewalls, is secured to the assembly 1 in a sealed relationship to prevent powder leakage. Sealing means 3 may typically be an O-Ring type of gasket, etc. Sealing means 3, in the form of a gasket, are located on the perimeter of mixing head 4 which is attached or secured to assembly 1 by shaft 5. Mixing head 4 contains the rotary blade mixing assembly (shown in FIGS. 3 and 4). Motor 6 is connected to gearbox 7 and gearbox 7, in turn, is connected to mixing head 4 by axle or shaft member (shown in FIG. 3) so as to be able to cause rotation of the mixing blades. The mixing system container may be inverted or counter inverted by causing shaft 5 to rotate. Such inversion is typically on the order of about 180°.

Shaft 5 may be rotated by turning wheel 8. Wheel 8 may be turned by hand or by a motor (not shown), depending upon the size of the system. Wheel 8 is connected to gearbox 9 and then shaft 5 to effect inversion by causing shaft 5 and connected mixing container 2 to rotate. Discharge of the contents at any desired time following mixing may be conveniently accomplished with use of a butterfly valve, iris valve, slide gate, ball valve, etc., which may be conveniently located on the side wall or bottom of mixing container 2. Removable shelf 10 may be used to support mixing container 2 prior to inversion.

FIG. 2 illustrates mixing system M of FIG. 1 in an inverted position. Please note that removable shelf 10 has been removed.

Figure 3:
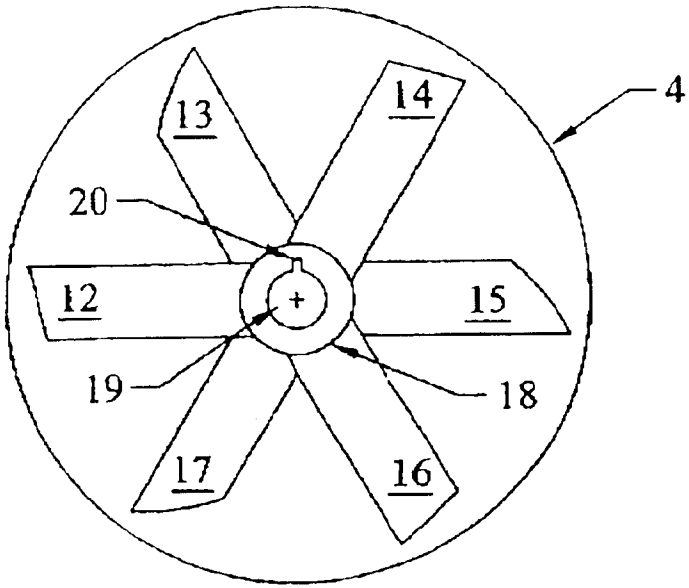
FIG. 3 is a top view of the rotary blade mixing assembly of the invention.

FIG. 3 is a top view of the rotary blade mixing assembly of the invention. As may be noted, six mixing blades, blades 12–17, are shown in the view. Blades 12, 14, and 16, constitute a set and occupy the same plane; and blades 13, 15, and 17, a second set, occupy its own plane. The plane for blades 13, 15, and 17 is separate from that of blades 12 14and 16 and disposed below such plane. Blades 12–17 are attached to hub 18, which in turn is attached to shaft 19. Keyway 20 ensures that hub 18 is rotationally locked to shaft 19. Shaft 19 is connected to a gearbox (shown only in FIG. 1 as element 7). Rotation of shaft 19 causes blade rotation.

Figure 4:
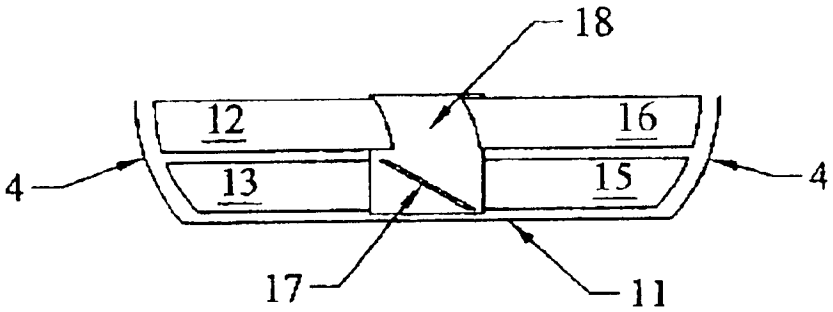
FIG. 4 is a front view of the rotary blade mixing assembly of the invention.

FIG. 4 is a front view of the rotary blade mixing assembly of the invention. Top blades 12and 16 are connected to hub 18 and central shaft 19 (not shown in FIG. 4). Blade 14 cannot be seen in this view. Blades 13 and 15 can be observed, and the leading edge of blade 17 can also be observed. Blade 17 (and all other five blades) is pitched at an angle of between about 20° and about 45° from horizontal to provide lift and shear to the material. An angle of from about 25° to about 40° is preferred because such angle provides an excellent balance between lift and shear forces. This angular range results in minimizing heat build-up in the powder. The number of mixing blades per set should be at least two to obtain adequate mixing and to balance the assembly. However, mixing effectiveness may be increased with additional blades. Thus, a set of two blades to multiple sets of two or more blades is contemplated. The use of two parallel sets of three blades has resulted in excellent mixing. The three blades are disposed at 120° intervals.

As evident from FIGS. 3 and 4, the blade assembly may be constructed by using six blades mounted on two planes affixed to a common hub, i.e., three blades per set that are spaced at 120° intervals. Each set of blades is designed independently to lift the material as well as to apply shear to the material to be mixed. The lifting action is designed to lift or move the material in an upward and outward direction along the sidewalls of the mixing container. The material then re-enters the mixing action of the blades in a cylindrical area centrally located above the blades in the mixing container. The force imparted to the material to be mixed is proportional to the distance from the center of the blade assembly. Blade speed, or angular velocity, increases as the distance from the center increases. Therefore, particles or powders that coincide with the blade will be subject to greater impact as the distance from the center increases. The effect of blade operation is most accurately measured at the blade tip. Suitable blade tip speed ranges from about 1000 ft/min to about 5000 ft/min, with about 3000–3500 ft/min being preferred. The use of the preferred speeds is especially suited for materials having a melt viscosity of about 2 Pa·s to about 85 Pa·s. However, when mixing other materials, other tip speeds may be appropriate.

Blade speed required to mix at high intensity depends upon the sweep diameter of the blade. The greater the diameter, the greater the circumference of the circle the blade revolves. As this distance increases, the speed in which the tip of the blade also increases as the blade travels through the circle. Blade tip speed is critical because it dictates the frictional heat that is derived at the tip as the tip contacts the powder. Comparable blade tip speed of a small diameter blade is obviously attained through higher shaft speed than that used for a larger diameter blade.

As mentioned previously, the method of the invention generally involves a method of mixing powders which includes providing a mixing container having a closed bottom portion and an open top portion which contains at least two powders that do not extend to the top of the container; placing a mixing head in an essentially sealed relationship with the open top portion of the container, the mixing head having a rotary blade mixing assembly which extends into a space in the mixing container between the powders and the sealed top of the container. The mixing head has a shaft connected to the rotary blade mixing assembly and extends out of the mixing container and is connected to an appropriate power means capable of causing the shaft and rotary blade mixing assembly to rotate. The mixing container is held in an upright position in a assembly. Rotation of the mixing blades commences in such space at a blade tip speed between about 1000 and 5000 ft/min. The mixing container is then inverted while the mixing blades rotate, causing the powders to fall into and collect in the former top portion of the mixing container. Subsequent mixing of the powders results in a uniform, homogenous powder. Following counter-inverting the mixing container to its original position, the mixing container is removed from the assembly.

The present invention may be advantageously used with a wide variety of coating powder compositions including thermosetting, thermoplastic, radiation curable dual systems, such as thermosetting/radiation curable, and fluorocarbon polymer thermosetting systems. Once a base coating powder having sufficient wetting properties, as measured by melt viscosity, is produced, a particulate tinting agent(s) and/or other additive(s) is then mixed with such particulate base coating powder to produce a desired color and/or other property. The composition behaves much like a liquid allowing complete dispersion of the tinting agent and/or additive particles in relatively short times because of the fluid-like nature of the resinous coating powder base composition, thereby reducing the opportunity for heat buildup in the powder and resultant powder fusion. An important commercial advantage of the invention is that a base coating powder can be produced and then stored to await the final, color-producing mixing step. To be able to obtain a desired colored powder by simply mixing a base and tinting agent would permit pre-production of large quantities of the base and then the use of a portion of such base to obtain a desired color rather than having a single production run capable of producing only one color. Obviously, shorter production and delivery times are possible with the invention. Moreover, if a coating powder manufacturer is in the midst of a production run of a given color, the only alternative to being able to quickly produce a different color could be to interrupt the run, clean the equipment, and then produce the other color. Then the equipment would require cleaning once more to produce the balance of the first run. This substantial problem is eliminated with the present invention, thus enabling a wide variety of colored powders to be quickly produced and shipped to customers without interruption of the base production run.

The present invention may be advantageously used with coating powder base compositions comprising a resin; curing agent in an amount effective to cure the resin (unless the resin is thermoplastic); an optional effective amount of a resin modifying agent to obtain a viscosity of the base composition of between about 2 Pa·s to about 85 Pa·s (Pascal-seconds); a flow agent in an optional amount up to about 5 phr; a degassing agent in an optional amount of up to about 5 phr; and an organic and/or inorganic pigment in an optional amount up to about 85 phr. The term phr means parts of ingredient per hundred parts of resin. The base composition has a melt viscosity range of from about 2 Pa·s to 85 Pa·s (measured using an ICI cone plate viscometer set at 160° C.) to achieve the necessary wetting properties which will permit uniform mixing of the base with a stable tinting agent and/or additive to produce a coating powder mixture that can be readily applied to a substrate to produce a high quality coating. The resin may be formulated to the above-specified melt viscosity or such melt viscosity may be obtained by incorporating a resin-modifying agent into the base composition. The stable tinting agent may comprise a mixed metal oxide, titanium dioxide, hybrid organic-inorganic material, or the like, and when present, be in an amount effective to tint the base composition, typically from about 0.01% to about 20% of the weight of the base.

Once the base composition is produced by conventional means such as mixing its respective constituents, extruding the mixture, and grinding the extrudate into a powder, and then optionally classifying the coating powder, the thus provided base compositions and tinting agent(s) and/or other additive(s) are mixed, preferably by dry mixing, into a final coating powder composition mixture having a desired color and/or other property.

A base composition melt viscosity range of from about 2 Pa·s to about 85 Pa·s is suitable, with a range from about 10 Pa·s to about 50 Pa·s being preferred, and with a range from about 15 Pa·s to about 30 Pa·s being most preferred. The above preferences lead to coating powders having optimized coating properties. Lower melt viscosities permit the inclusion of larger amounts of tinting agents. However, melt viscosities at the lower end of the about 2 Pa·s to about 85 Pa·s range, tend to produce lesser quality coatings because of excessive flow.

Tinting agents are compounds used to change the color of a pre-mixed thermosetting coating powder base composition. The tinting agents have a positive color value and are in the form of a dry powder. Tinting agents may be mixed metal oxides, titanium dioxide, and/or stable hybrid organic-inorganic materials. The tinting agent may comprise mixtures of the above tinting agents.

It is important for the tinting agents to be chemically stable because the interaction of the coated surface with other chemicals would be detrimental to the tinting agents which are located at or near the surface of the coating. For example, a fingerprint, solvent, or any other substance could react with the tinting agent. Calcined inorganic components are suitable because such compounds are formed at very high temperatures and have crystal lattice arrangements that render such tinting agents impervious to most chemicals.

Another reason for using the tinting agents discussed above is that such agents can be finely ground to obtain particle sizes on the order of 5 microns or less with resultant reliable particle size distributions. It is preferred to obtain particle sizes on the order of 3 microns or less. Particle size and distribution are important because individual particles are difficult to see with the naked eye once oriented in the cured or solidified coating. In addition, the tinting agents of the invention exhibit very good ultraviolet (UV) stability that leads to good weatherability.

The amount of tinting agent used in the coating powder base compositions is an amount effective to tint the coating powder base composition to obtain a desired color. The amount of tinting agent used in the coating powder base composition may vary depending upon the particular tinting agent employed as well as for the particular end use of the coating powder base composition. In a typical embodiment, the tinting agent may be present in the coating powder base composition up to about 25%.

Other additives may also be post-mixed with the pre-mixed coating powder base compositions. Such additives may be included with or without the above-mentioned tinting agents. An additive is an agent that is combined with the premixed coating powder base composition to alter a coating property of the base composition such as by lowering gloss, enhancing mar-resistance, minimizing outgassing, obtaining a desired textured surface, obtaining a desired structured surface, or enhancing electrical conductivity. The additives which may be employed consist of a wide variety of compounds including finely ground amorphous silica, low molecular weight polyolefins, highly branched, high molecular weight polymers such as glycidyl methacrylate acrylic cured polyesters, that when post-mixed with the base composition can provide desirable coating property(ies). The additives desirably have a small particle size, about 0.1–2.5 microns to maximize total surface area per unit mass. However, particles up to about 35 microns or more can be utilized to achieve desired physical coating properties, such as gloss. The additives are thus more efficient in modifying the powder coating base composition for the desired property. Non-limiting illustrative additives include deglossing agents, mar-resistance enhancing agents, outgassing agents, texturing agents, structuring agents, and conductive agents. For example, polyethylene wax, in finely ground powder (<1 micron) may be added to a base composition in specific proportions to impart such properties as lubricity, reduced gloss, or degassing. In addition, a micronized clear polyurethane coating powder can be effective to degloss polyester-TGIC base powders due to the incompatibility of the two chemistries. These additives can be used in conjunction with the tinting agents so that all of the coating properties can be adjusted to achieve a given objective.

We claim:

1. A mixing system comprising:

(a) An assembly for holding a mixing container, said assembly having means for inverting said mixing container up to about 180°, said assembly having a mixing head containing a rotary blade mixing assembly which is connected to a shaft, said rotary blade mixing assembly having at least two sets of mixing blades connected to a central shaft and arranged in parallel planes, each set having at least two mixing blades which are connected to said central shaft, and each blade pitched at an angle from about 20° to about 45° from horizontal as measured following a 180° inversion of said mixing container;

(b) A mixing container for containing materials to be mixed having a closed bottom portion, an open upper portion, and sidewalls and being held in a generally upright position by said assembly, said upper portion of said mixing container being in sealed relationship with said mixing head in a manner that said rotary blade mixing assembly extends into an upper portion of said mixing container; and (c) Power means connected to said mixing head shaft to cause rotation of said shaft thereby causing rotation of said mixing blades.

2. The mixing system of claim 1, wherein said rotary blade mixing assembly comprises two sets of mixing blades with each set having three blades.

3. The mixing system of claim 1, wherein said blades are pitched at an angle from about 25° to about 40°.

4. A method of mixing powders, comprising:

(a) Providing a mixing container having a closed bottom portion, an open top portion, and sidewalls which contains at least two powders in an amount that does not extend to the top of said container thereby creating a space at the top of said powders;

(b) Holding said mixing container in an upright position in an assembly and placing a mixing head contained in said assembly in sealed relationship with said open top portion of said mixing container, said mixing head having a rotary blade mixing assembly comprising at least two sets of mixing blades connected to a central shaft and arranged in parallel planes, each set having at least two mixing blades which are connected to said central shaft, and each blade pitched at an angle from about 20° to about 45° from horizontal as measured following a 180° inversion of said mixing container, said rotary blade mixing assembly extending into said space in said mixing container;

(c) Commencing rotation of said mixing blades in said space;

(d) inverting said mixing container while said mixing blades are rotating to cause said powders to fall to the former top portion of said mixing container, (e) Rotating said mixing blades at a blade tip speed from about 1000 ft/min to about 5000 ft/min to cause said powders to be lifted along said mixing container sidewalls and then to fall down along a central portion of said mixing container thereby obtaining a uniform, homogeneous powder mixture;

(f) Counter inverting said mixing container to its original position; and (g) Removing said mixing container from said assembly.

5. The method of claim 4, wherein said rotary blade mixing assembly comprises two sets of mixing blades with each set having three blades.

6. The method of claim 4, wherein said blades are pitched at an angle from about 25° to about 40°.

7. The method of claim 4, wherein said blade tip speed is from about 3000 ft/mm to about 3500 ft/mm.

8. The method of claim 4, wherein one of said powders is a resinous base composition having a melt viscosity from about 2 Pa·s to about 85 Pa·s.

9. The method of claim 8, wherein said melt viscosity is from about 10 Pa·s to about 50 Pa·s.

10. The method of claim 8, wherein said resinous base composition is mixed with a particulate tinting agent.

11. The method of claim 8, wherein said resinous base composition is mixed with a particulate additive.

* * * * *